US005126798A

United States Patent [19]

LeRoy et al.

[11] Patent Number: 5,126,798

[45] Date of Patent: Jun. 30, 1992

[54] CLEANING ASSEMBLY FOR AN ELECTROSTATOGRAPHIC REPRODUCTION APPARATUS

[75] Inventors: Robert D. LeRoy; Wayne W. Forrest, both of Rochester; Richard G. Luther, Hilton, all of N.Y.

[73] Assignee: Eastman Kodak Company, Rochester, N.Y.

[21] Appl. No.: 767,707

[22] Filed: Sep. 30, 1991

[51] Int. Cl.[5] ..... G03G 21/00

[52] U.S. Cl. ..... 355/297; 355/296; 355/298; 355/299; 355/301

[58] Field of Search ..... 355/297, 296, 298, 299, 355/301, 302, 215; 118/652

[56] References Cited

U.S. PATENT DOCUMENTS

| | | | |
|---|---|---|---|
| 4,435,073 | 3/1984 | Miller | 355/298 X |
| 4,984,028 | 1/1991 | Tonomoto | 355/297 |
| 4,989,047 | 1/1991 | Jugle et al. | 355/297 |
| 5,031,000 | 7/1991 | Pozniakas et al. | 355/297 |
| 5,066,983 | 11/1991 | Tonomoto | 355/297 |

FOREIGN PATENT DOCUMENTS

| | | | |
|---|---|---|---|
| 0114076 | 7/1983 | Japan | 355/299 |
| 0112276 | 4/1989 | Japan | 355/299 |
| 0257890 | 10/1989 | Japan | 355/299 |

*Primary Examiner*—A. T. Grimley
*Assistant Examiner*—Matthew S. Smith
*Attorney, Agent, or Firm*—Lawrence P. Kessler

[57] ABSTRACT

In an electrostatographic reproduction apparatus wherein a latent image charge pattern is formed on a moving dielectric member web and developed with pigmented marking particles to form a transferable developed image on the dielectric member web, an improved cleaning assembly for removing residual marking particles and debris from the dielectric member web. The improved cleaning assembly comprises a cleaning brush supported in a housing. The housing is located to position the peripheral surface of the cleaning brush in cleaning engagement with the dielectric member web, and a vacuum is established within the housing. A relatively stiff cleaning blade is supported in engagement with the dielectric member web at a predetermined positional orientation under a sufficient loading so as to cause the dielectric member web to be substantially deflected by the blade.

9 Claims, 3 Drawing Sheets

CLEANING ASSEMBLY FOR AN ELECTROSTATOGRAPHIC REPRODUCTION APPARATUS

BACKGROUND OF THE INVENTION

This invention relates in general to a cleaning assembly for an electrostatographic reproduction apparatus, and more particularly to an improved cleaning assembly which includes a cleaning blade, attached to the housing of a vacuum-assisted cleaning brush, in engagement with the dielectric member web to be cleaned so as to deflect such dielectric member web.

In a typical electrostatographic reproduction apparatus, a latent image charge pattern of information to be copied is formed on a dielectric member and thereafter developed with charged pigmented marking particles. The charged marking particles adhere to the latent image charge pattern on the dielectric member to form a developed image. The developed image is then transferred to a receiver member to form the desired reproduction of the information to be copied. After transfer of the developed image, any residual marking particles remaining on the dielectric member are removed and the dielectric member is reused by having subsequent latent image charge patterns formed thereon.

Efficient cleaning of the dielectric member is required to prevent undesirable artifacts from being produced on the copied information. One method for removal of the residual marking particles from the dielectric member after transfer is typically accomplished by scrubbing the surface of the dielectric member with a rotating brush operating in a vacuum atmosphere to attract the particles (and any additional debris) from the dielectric member and transport the particles to a remote collection chamber. Another method for removing residual marking particles includes scraping the dielectric member with a cleaning blade.

In modern high-speed electrostatographic reproduction apparatus, the dielectric member is, for example, a flexible web movable about a closed loop path in operative association with the electrographic process stations. In certain instances, the dielectric member cleaning brush or cleaning blade does not prove efficient in removing the residual marking particles or debris from the web. As noted, this results in undesirable artifacts being formed on the copies of the information being reproduced. As such, yet another method for removing residual marking particles has been proposed. This method utilizes a rotating brush combined with a scraping blade (see for example U.S. Pat. Nos. 3,918,808; 4,640,599; and 4,984,028).

Further, in the recent U.S. pat. Nos. 4,989,047 (issued Jan. 29, 1991, in the name of Jugle et al) and 5,031,000 (issued July 9, 1991, in the name of Pozniakas et al), it is disclosed that the utilization of a blade cleaner in associated with the vacuum-assisted brush cleaner, to improve the overall effectiveness in the cleaning of a dielectric member web, is best accomplished when the blade is located at a very low attack angle relative to the dielectric member and engages the dielectric member with a very low pressure. The mechanism for providing such low attack angle/low pressure arrangement of this cleaning assembly is difficult to maintain in the desired relative position with the dielectric member web. Further, it is directed to a particular cleaning problem (i.e., agglomeration removal), and does not address other cleaning issues. As a result, it is not completely effective in carrying out the overall desired web cleaning process.

SUMMARY OF THE INVENTION

This invention is directed to an improved cleaning assembly for removing residual marking particles and debris from the dielectric member web of an electrostatographic reproduction apparatus wherein a latent image charge pattern is formed on a moving dielectric member web and developed with pigmented marking particles to form a transferable developed image on the dielectric member web. The improved cleaning assembly provides for more effective cleaning and has increased set-up latitude. Such cleaning assembly comprises a cleaning brush supported in a housing. The housing is located to position the peripheral surface of the cleaning brush in cleaning engagement with the dielectric member web, and a vacuum is established within the housing. A relatively stiff cleaning blade is supported in a predetermined orientational engagement with the dielectric member web under a sufficient loading so as to cause the dielectric member web to be substantially deflected by the blade.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENT

Figure 1:
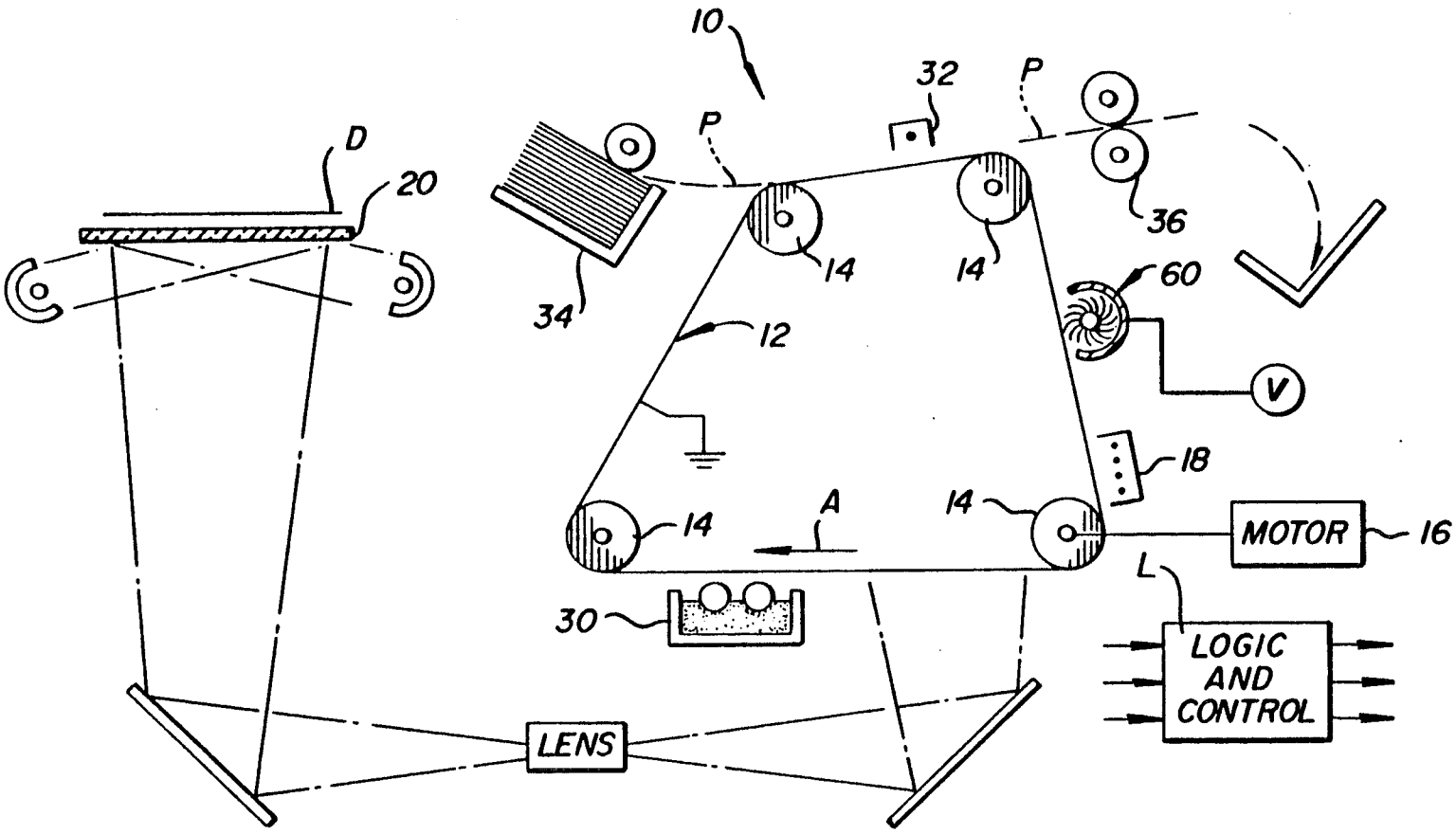
FIG. 1 is a schematic illustration of an exemplary electrostatographic reproduction apparatus including an improved cleaning assembly according to this invention.

Referring now to the accompanying drawings, FIG. 1 schematically shows an exemplary electrostatographic reproduction apparatus 10 including an improved cleaning assembly, designated generally by the numeral 60, according to this invention. The exemplary reproduction apparatus 10 includes a dielectric member in the form for example of a composite web 12 having a photosensitive surface layer and a grounded conductive layer. The web 12 is supported on a series of rollers 14, one of which is selectively driven by a motor 16 to move the web about a closed loop path in the direction of arrow A. Electrographic process stations are located about the closed loop path in operative association with the web 12 and their operation is controlled by a typical microprocessor-based logic and control unit L having an operating program and receiving appropriate input and timing signals.

The electrographic process, under control of the unit L, functions as follows. The motor 16 is activated to move the dielectric member web 12 about its closed loop path in the direction of arrow A. A corona charger 18 applies a uniform electrostatic charge to the web 12 as it moves past the charger. In an information receiving area of the web, the uniform charge is altered to form an image-wise latent image charge pattern corresponding to information to be copied. With the particular reproduction apparatus 10 illustrated, the charge pattern is formed for example by exposing the web 12 to a reflected light image of an original document D placed on a transparent platen 20. Of course, other well known optical or electronic mechanisms may be utilized to alter the uniform charge on the web in an image-wise pattern corresponding to information to be reproduced. After the latent image charge pattern is formed on the web 12, that portion of the web bearing such image is brought into operative relation with a developer station 30. The developer station, for example including a magnetic brush development mechanism, transports pigmented marking particles into contact with the web. The marking particles adhere to the latent image charge pattern on the web to develop such image.

The developed image on the web 12 is brought, by continued web movement about the closed loop path, to a transfer station 32. A receiver member is fed from a supply hopper 34 and transported along a path P to the transfer station 32 in timed relation with the moving web 12 so that the receiver member is in register with the developed image on the web. In the transfer station 32, an electrical field is established to transfer the marking particles of the developed image from the web 12 to the receiver member. After transfer of the marking particles to the receiver member, the receiver member bearing the transferred image is stripped from the web and transported to a fusing station 36, where the transferred image is fixed to the receiver member by heat and/or pressure for example, and then to an output receptacle for operator retrieval.

Meanwhile, the web 12 is moved through a cleaning assembly 60 (the improved assembly according to this invention to be fully described hereinbelow), where residual (non-transferred) marking particles and other debris collected on the web are removed. The web is thus conditioned for reuse in forming subsequent information reproductions. In analyzing the cleaning functions required to efficiently remove residual marking particles and debris from a dielectric member web to condition the web for reuse, it has been found that the spacing of the housing for a typical cleaning assembly (including a rotating, vacuum-assisted, cleaning brush) from the dielectric member web has an important relation to the efficiency of the cleaning action performed by the brush. If the housing is positioned particularly close to the web, the cleaning action of the brush is excellent but the air flow from outside the housing is choked off. This results insignificant dusting outside the housing, with concomitant increased contamination within the reproduction apparatus. On the other hand, if the housing is positioned particularly far from the the web, the air flow from outside the housing is relatively unimpeded and provides excellent contamination control; however, the brush fibers then have minimal engagement with the web resulting in substantially decreased cleaning efficiency with an undesirable build-up of scum on the web. Thus, for both efficient cleaning and contamination control, the cleaning brush housing must be accurately positioned with little tolerance available in its setup relative to the web.

It has been determined that the addition of a cleaning blade to the cleaning assembly provides an unexpected advantage when the cleaning blade is held in a predetermined positional orientation relative to the dielectric member web. At the predetermined positional orientation (described fully hereinbelow), the scraping action of the cleaning blade serves to remove marking particles and debris adhering to the web, and also prevents the build-up of scum on the web (i.e., facilitates conditioning of the web for reuse). It is noted that it is important to prevent scum build-up on the web in order that the electrographic properties of the web are not degraded over time to maintain the operational effectiveness of the web. Additionally, the blade substantially contains any contaminants within the effective environment of the vacuum-assisted cleaning brush. Accordingly, the brush housing can be spaced from the web a sufficient distance to accomplish excellent contamination control without having to consider the effect of brush spacing to the web for scum removal as mentioned above. That is, the brush housing can be spaced further from the web than heretofore possible with prior known cleaning assemblies without adversely affecting the overall performance of the cleaning assembly. As a result, setup tolerance for the housing relative to the web is substantially increased.

Figure 2:
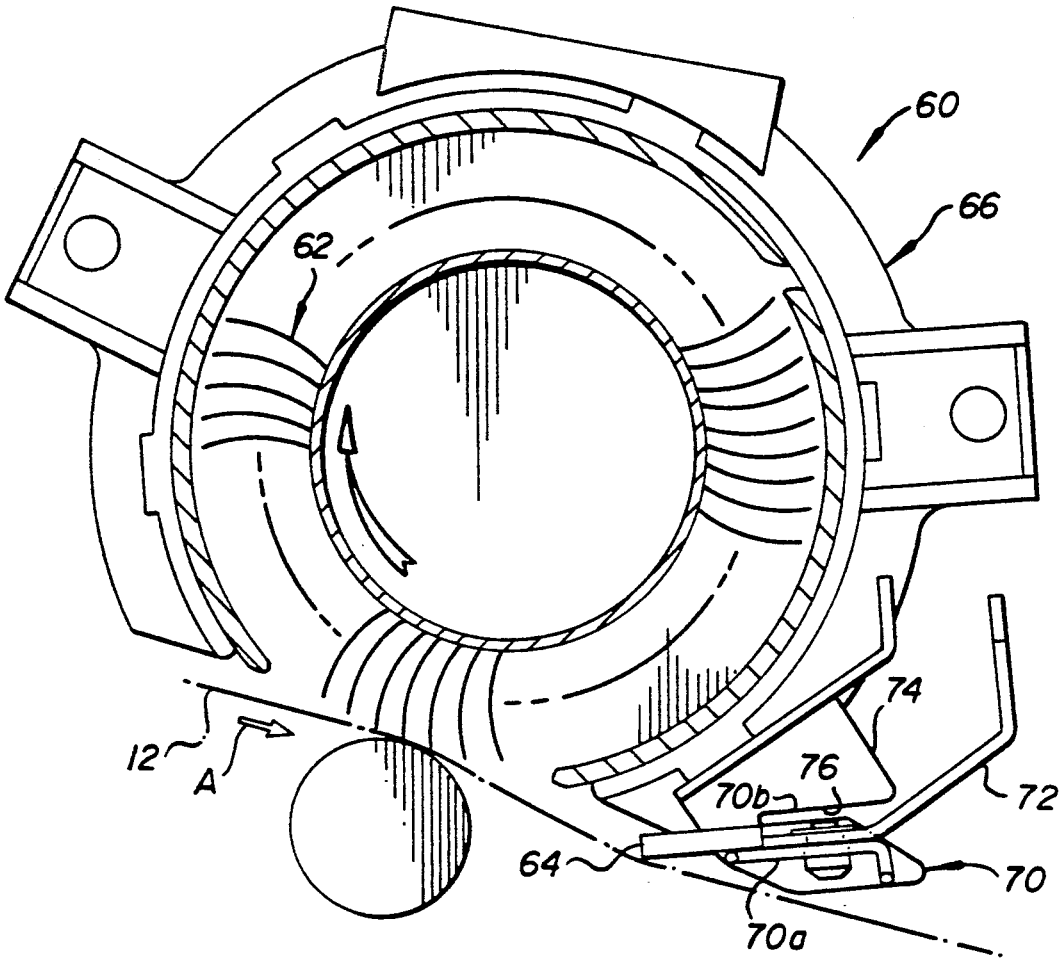
FIG. 2 is an end elevational view, in cross-section, of the improved cleaning assembly according to this invention.

The improved cleaning assembly 60 according to this invention includes a vacuum-assisted cleaning brush 62 and a cleaning blade 64 arranged in a unique cooperative relationship (see FIG. 2). The cleaning brush 62 is a multi-fiber brush mounted for rotation in a housing 66. The housing 66 is adjustably positioned, in any well known manner, adjacent to the web 12 such that end portions of the fibers of the brush 62 are brought into sweeping contact with the web on rotation of the brush. The housing 66 is in flow communication with a vacuum source V (see FIG. 1) which establishes an air flow into the housing from the environment surrounding the housing. The sweeping action of the brush 62 and the air flow established by the vacuum source V effect removal of loose marking particles and debris from the surface of the web.

Figure 3:
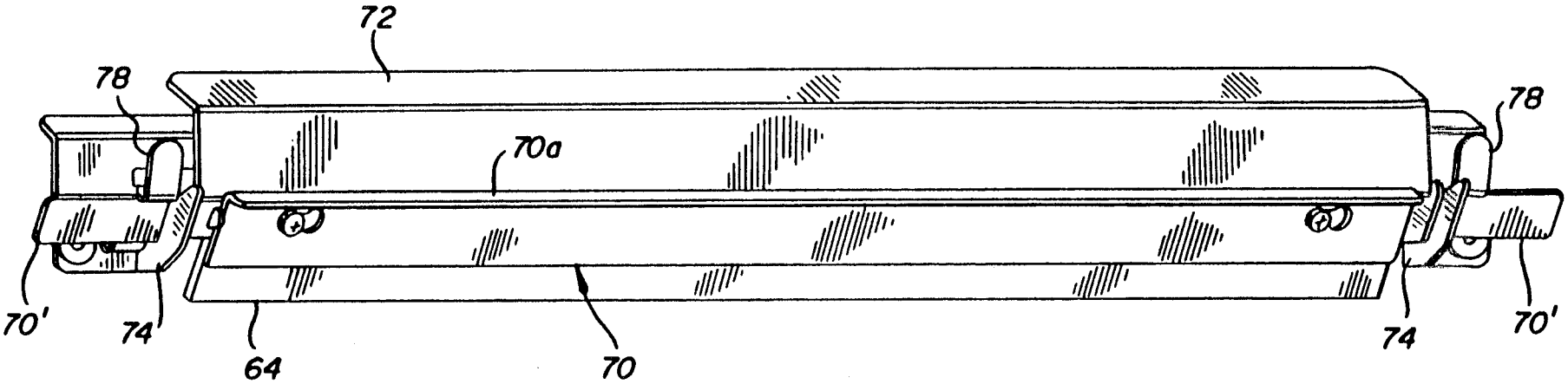
FIG. 3 is a view, in perspective, of the cleaning blade of the improved cleaning assembly according to this invention.

The cleaning blade 64 serves to efficiently remove additional marking particles and debris not removed by the cleaning brush 62, for example particles and debris substantially adhering to the surface of the web 12. The cleaning blade 64 comprises a relatively stiff strip of material, such as polyurethane about 0.3 cm thick and of a durometer in the range of approximately 70–85 Shore A for example. The blade 64 is mounted in a holder 70. The holder 70 has opposing portions **70*a*, 70*b* which are connected by appropriate fasteners to sandwich the blade 64 therebetween. Additionally, the holder 70 includes a portion extending along the length of the blade 64 in a direction away from the marginal edge of the blade (see FIG. 3). The portion 72 forms catch tray for material removed from the web 12** by the blade.

Figure 5:
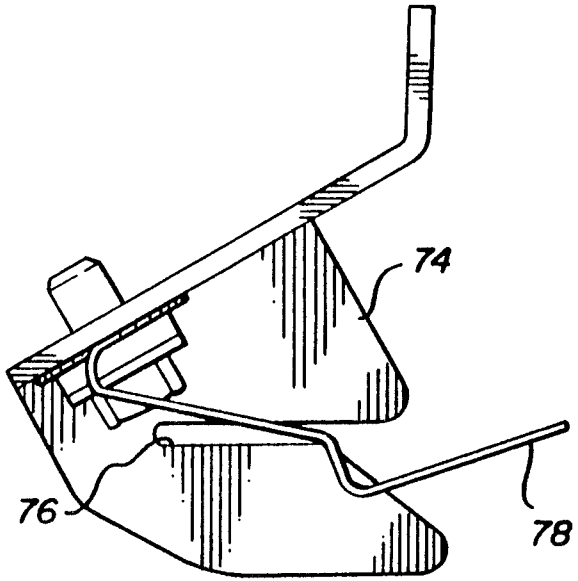
FIG. 5 is an end elevational view of the support for mounting the cleaning blade to the cleaning brush housing of the improved cleaning assembly according to this invention.

The holder 70 for the blade 64 is attached to the housing 66 for the cleaning brush 62 by being receivable in end brackets 74 fixed to the housing. The end brackets 74 respectively define a slot 76 (one bracket and slot shown in FIG. 5) for receiving tabs 70' of the holder 70. When the tabs 70' are received in the slots 76 respectively, spring members 78 (see FIG. 5) attached to the end brackets 74 engage the tabs and retain the holder 70 in fixed relation in the end brackets.

Figure 4:
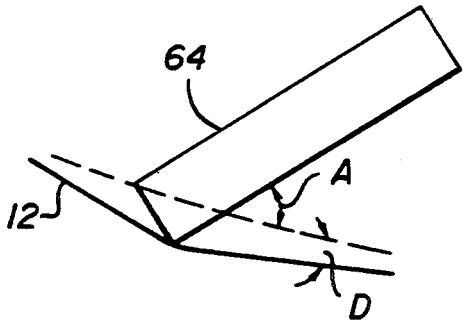
FIG. 4 is a schematic view, on an enlarged scale, of the cleaning blade of the improved cleaning assembly according to this invention showing its particular relationship to the dielectric member web.

The location of the end brackets 74 attached to the housing 66, the angle of the slots 76, and the dimensional configuration of the blade 64 and holder 70 assure the essential predetermined positional orientation of the blade relative to the web 12. As noted above, such predetermined positional orientation is essential to assure the effective operation of the cleaning blade 64. As shown in FIG. 4, the blade 64 engages the web 12 at an angle to the normal path of travel of the web and under a force which, due to compliance of the web, substantially deflects the web from its normal path of travel (shown as a dashed line in FIG. 4). The angle at which the blade engages the web, referred to the attack angle designated as angle A, is in the range of approximately 25°-30°. The loading of the blade 64 on the web 12 is in the range of approximately 12-30 gr/cm, which results in a deflection of the web in the range of approximately 0.25-0.600 cm from its undeflected location. The angle of deflection of the web, designated as angle D, is in the range of approximately 1°-10°. The deflection of the web 12 by the blade 64 creates a substantially sharp discontinuity in the web as it travels past the blade. It is believed that material adhering to the web is shattered as the web travels through such discontinuity, rendering the material easier to clean from the web. Material cleaned by the blade 64 builds up in the catch tray 72. Since the blade and catch tray are within the effective range of the air flow created by the vacuum source V into the cleaning brush housing 66, at least a portion of the material building up on the blade and catch tray is entrained in the air flow so as to be cleaned away by the brush. As such, it can be seem that the combined vacuum-assisted cleaning brush 62 and cleaning blade 64 of the cleaning assembly 60 are interdependent, each serving to enhance the operation of the other.

The invention has been described in detail with particular reference to preferred embodiment thereof, but it will be understood that variations and modifications can be effected within the spirit and scope of the invention.

We claim:

1. In an electrostatographic reproduction apparatus wherein a latent image charge pattern is formed on a moving dielectric member web and developed with pigmented marking particles to form a transferable developed image on said dielectric member web, an improved cleaning assembly for removing residual marking particles and debris from said dielectric member web, said improved cleaning assembly comprising:

a cleaning brush having a peripheral surface;

a housing supporting said cleaning brush, said housing being located to position the peripheral surface of said cleaning brush in cleaning engagement with said dielectric member web;

means for establishing a vacuum within said housing;

a relatively stiff cleaning blade; and means for supporting said cleaning blade in engagement with said dielectric member web at a predetermined positional orientation under a sufficient loading so as to cause said dielectric member web to be substantially deflected by said blade in the range of approximately 025-0.600 cm.

2. The improved cleaning assembly of claim 1 wherein the loading of said dielectric member web is in the range of approximately 12-30 gr/cm.

3. The improved cleaning assembly of claim 2 wherein the angle of deflection of said dielectric member web by said cleaning blade is in the range of approximately 1°-10.0°.

4. The improved cleaning assembly of claim 1 wherein said means for supporting said cleaning blade is located to position said cleaning blade downstream, in the direction of dielectric member web movement of said housing.

5. The improved cleaning assembly of claim 1 wherein said means for supporting said cleaning blade is connected to said housing to position said cleaning blade downstream, in the direction of dielectric member web movement, of the area of engagement of said cleaning brush with said dielectric member web.

6. The improved cleaning assembly of claim 5 wherein said cleaning blade is positioned by said support means to be within the effective area of said vacuum established within said housing.

7. The improved cleaning assembly of claim 1 wherein said cleaning blade includes a catch tray for collecting residual marking particles and debris scraped from said dielectric member web by said blade.

8. An improved cleaning assembly for removing pigmented marking particles and debris from a web utilized in an electrostatographic reproduction apparatus in which a transferable marking particle image is formed on said web and subsequently transferred therefrom, said improved cleaning assembly comprising:

a cleaning brush having a peripheral surface;

a housing supporting said cleaning brush, said housing being located to position the peripheral surface of said cleaning brush in cleaning engagement with said web;

means for establishing a vacuum within said housing;

a relatively stiff cleaning blade; and means for supporting said cleaning blade in engagement with said web at a predetermined positional orientation under a sufficient loading in the range of approximately 12-30 gr/cm so as to cause said web to be substantially deflected by said blade in the range of approximately 025-0.600 cm.

9. The improved cleaning assembly of claim 8 wherein the angle of deflection of said dielectric member web by said cleaning blade is in the range of approximately 1°-10°.

* * * * *